US008282444B2

(12) United States Patent
Place

(10) Patent No.: US 8,282,444 B2
(45) Date of Patent: Oct. 9, 2012

(54) OVERLAY SANDER

(75) Inventor: Brent K. Place, Hager City, WI (US)

(73) Assignee: Actuant Corporation, Menomonee Falls, WI (US)

( * ) Notice: Subject to any disclaimer, the term of this patent is extended or adjusted under 35 U.S.C. 154(b) by 482 days.

(21) Appl. No.: 12/522,106

(22) PCT Filed: Jan. 4, 2008

(86) PCT No.: PCT/US2008/050206

§ 371 (c)(1), (2), (4) Date: Jul. 2, 2009

(87) PCT Pub. No.: WO2008/086160

PCT Pub. Date: Jul. 17, 2008

(65) Prior Publication Data

US 2010/0029184 A1 Feb. 4, 2010

Related U.S. Application Data

(60) Provisional application No. 60/883,448, filed on Jan. 4, 2007.

(51) Int. Cl.
*B24B 21/00* (2006.01)

(52) U.S. Cl. ..... 451/296; 451/299; 451/303; 451/355

(58) Field of Classification Search ..... 451/296, 451/299, 303, 355

See application file for complete search history.

(56) References Cited

U.S. PATENT DOCUMENTS

| | | | | |
|---|---|---|---|---|
| 3,759,146 | A | 9/1973 | Brotherton | |
| 4,483,106 | A * | 11/1984 | Wachs et al. | 451/439 |
| 4,739,685 | A * | 4/1988 | Ricci | 82/113 |
| 4,939,964 | A * | 7/1990 | Ricci | 82/113 |
| 5,189,933 | A | 3/1993 | Ricci | |
| 5,549,024 | A * | 8/1996 | Ricci | 82/113 |
| 5,881,618 | A | 3/1999 | Ricci et al. | |
| 6,592,307 | B2 * | 7/2003 | Hsieh | 409/139 |
| 6,619,164 | B1 * | 9/2003 | Ricci et al. | 82/113 |
| 2007/0102488 | A1 * | 5/2007 | VanderPol et al. | 228/101 |
| 2010/0129171 | A1 * | 5/2010 | Vanderpol et al. | 409/179 |

OTHER PUBLICATIONS

The International Search Report and Written Opinion as mailed on Jun. 27, 2008 for International Patent Application PCT/US2008/050206.

* cited by examiner

*Primary Examiner* — Maurina Rachuba
(74) *Attorney, Agent, or Firm* — Quarles & Brady LLP

(57) ABSTRACT

A belt sander includes a housing and an endless sanding belt supported by the housing. A first shaft is connected to the housing, and the housing is pivotable about the first shaft. A second shaft is connected to the housing and offset from the first shaft. The sander is mounted to the rotating portion of a rotary machining clam shell trackway and revolved around a pipe surface to be sanded while biasing the sander against the surface. The sander may also be pivotable to sand a tapered surface.

19 Claims, 3 Drawing Sheets

OVERLAY SANDER

CROSS REFERENCE TO RELATED APPLICATIONS

This application represents the national stage application of International Application PCT/US2008/050206 filed 4 Jan. 2008, which claims the benefit of U.S. Provisional Patent Application 60/883,448 filed on Jan. 4, 2007, which are incorporated herein by reference in their entirety for all purposes.

FIELD OF THE INVENTION

The present invention relates to portable machining tools or machine in place machining tools, and, more particularly, to an overlay sander that can smooth the weld overlay on a pipe.

BACKGROUND OF THE INVENTION

It is sometimes necessary to machine in place existing equipment for the purpose of testing, repairing and/or reconditioning the equipment. This process may be a result of the original fabrication of the machine or testing thereof, machine breakdown or malfunction, or may be part of a repair or maintenance program to overcome normal wear and tear or to prevent a malfunction of the equipment.

For example, relatively large piping which may be part of a pipeline, building, plant machinery, ship or other structures/devices, can include overlays which are a result of a welding process during the initial fabrication of the piping, or a repair or maintenance of the equipment. The overlays are basically weld buildup rings, or weld crowns, of inconel (a hard, tough material), or other material, around the outer perimeter of the piping or piping component such as a nozzle or valve, in the vicinity of the weld. The necessity of providing a juncture on a pipe that is professionally finished with a defect-free weld has been appreciated for some time, and more particularly in the case of nuclear power plants and pipelines, for example, the necessity of providing junctures that are reliable and durable is of the utmost importance. Consequently, the weld crowns need to be smoothed out in order for testing equipment to be used to check for cracks, wall thickness, etc. Further, the equipment size, location and connection to other structures may determine that it is advantageous to machine the equipment in place, rather than remove it from its operational configuration for refurbishment.

A known method of smoothing out the weld crowns is to use an axial feed slide mounted to a "clamshell" and cut or machine the overlay. Clamshells are portable pipe lathes that are connected to the outside of the pipe, where the cutting tool can move around the outside perimeter of the pipe to machine the outside of the pipe. Such devices are known in U.S. Pat. Nos. 4,739,685, 4,939,964, 5,549,024 and 6,619,164, for example. One problem with this method is that the machine would cut round and most overlays are not perfectly round. Because of this, more material has to be removed than necessary to get the entire overlay to be smooth. This also requires extra time.

The time element can be critical in pipelines, nuclear reactors, and the like, where downtime can be very costly and the necessity of providing junctures that are reliable and durable is of the utmost importance. Frequently, the working conditions associated with the pipe machining equipment have been quite hostile either to the machine or to the machine operator. For example, in nuclear reactors, the necessity for pipe replacements has been such that these types of maintenance procedures are required quite frequently. However, maintenance personnel may only work in an area that is radioactively hot for extremely short periods of time. Accordingly, the desirability of an apparatus for finishing pipes which can be set up in a minimal amount of time, can complete the machining in a minimum of time, and can be initialized and dismantled in a minimal amount of time has obtained increasing importance and acceptance in the industry.

What is needed in the art is an apparatus and method of machining an exterior surface of equipment, particularly piping, that can machine in place existing equipment and which can smooth weld crowns or other elements that may not be perfectly round, or perform other machining, efficiently.

SUMMARY OF THE INVENTION

The present invention provides an apparatus and method of machining an exterior surface of equipment, particularly piping, that can machine in place existing equipment and can smooth weld crowns or other elements which may not be perfectly round, or perform other machining, efficiently. More particularly, the present invention provides an overlay sander for such purposes.

The foregoing features and other advantages of the invention appear in the detailed description which follows. In the description, reference is made to the accompanying drawings which illustrate a preferred embodiment of the invention.

DETAILED DESCRIPTION OF THE PREFERRED EMBODIMENT

Figure 1:
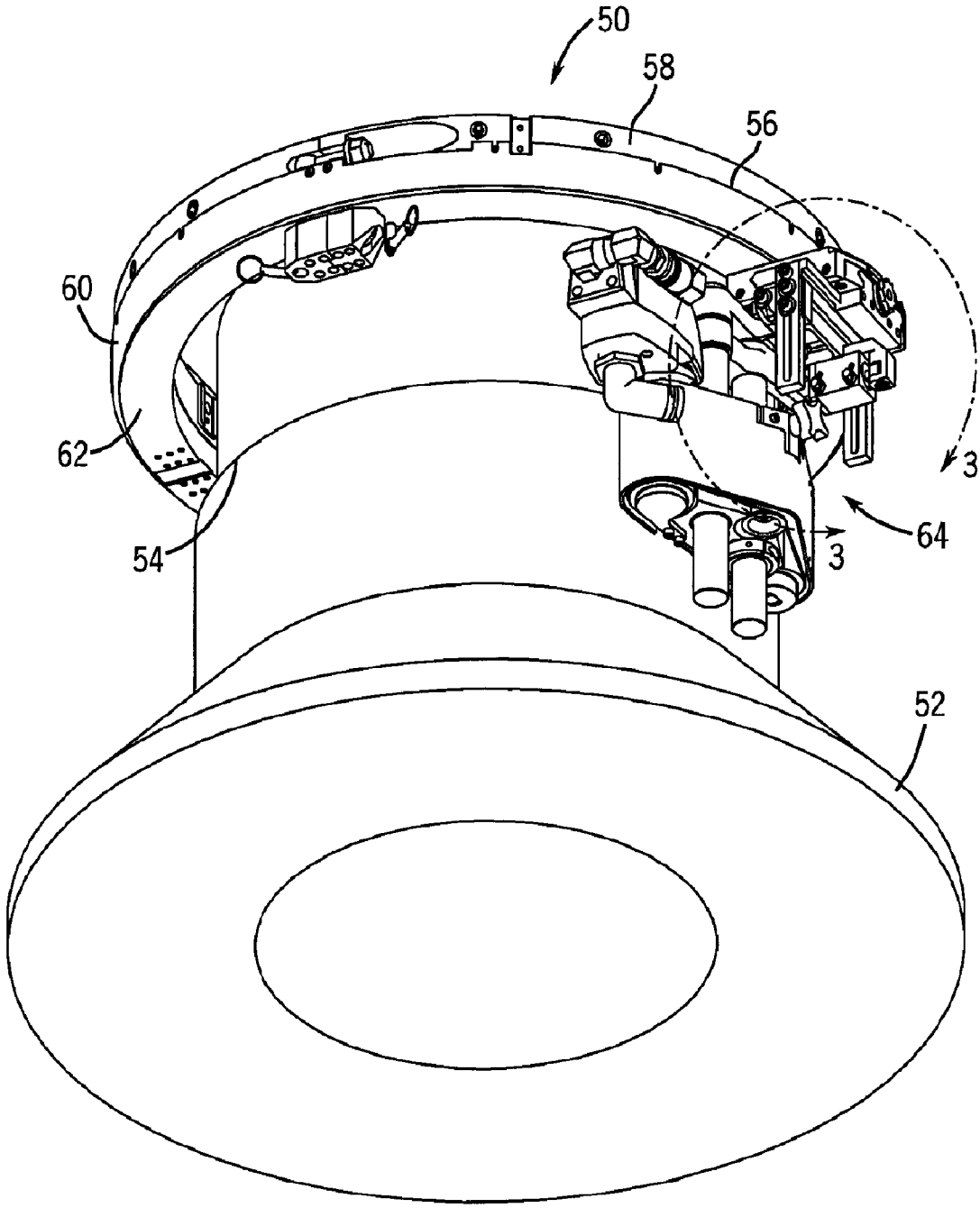
FIG. 1 is a perspective view of an embodiment of an overlay sander mounted to a clamshell that, in turn, is mounted to piping, according to the present invention.

Referring now to the drawings, and, more particularly, to FIG. 1, there is shown a machining apparatus 50 connected to pipe structure 52 having an overlay, weld crown or other work surface 54. Weld crown 54 is shown schematically, but will typically have an irregular width and height. Machining apparatus 50 includes a portable pipe lathe or clamshell 56 as is described in U.S. Pat. Nos. 4,739,685, 4,939,964, 5,549,024 and/or 6,619,164, for example, and incorporated herein by reference. Clamshell 56 is not limited by the cited references, but can also include other embodiments of similar devices. Clamshell 56 generally includes stationary portion 58 fixedly connected to pipe structure 52, and ring gear housing 60, each of which include adjoining semicircular segments which allow them to be positioned circumferentially around the pipe. The two are joined together by bearings internal to the construction. As such, the rotatable portion 62 can be made to spin about the central axis of stationary portion 58 when the ring gear is driven by a motor driven drive gear. An overlay sander 64 is connected to rotatable portion 62.

Figure 2:
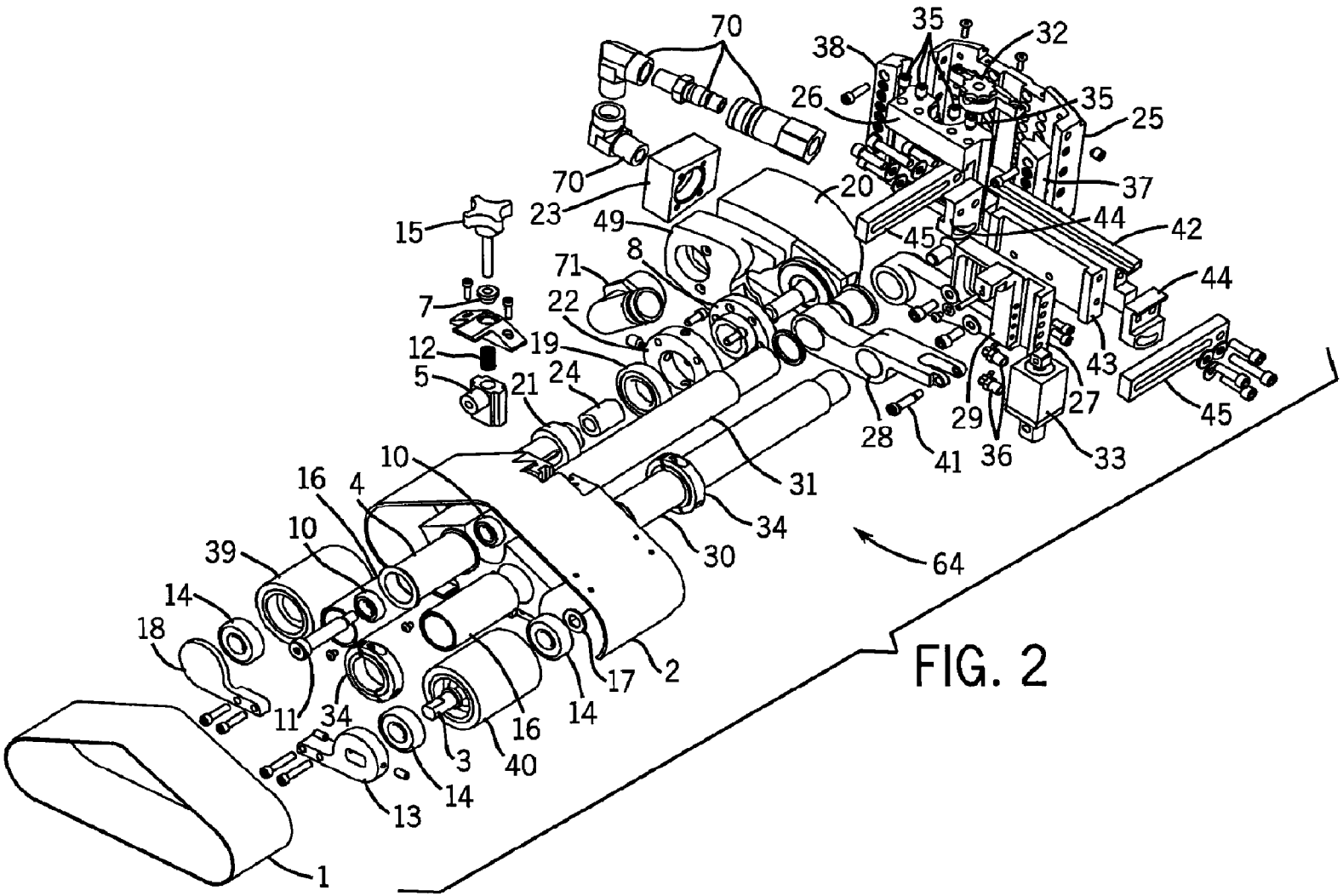
FIG. 2 is a perspective exploded view of the overlay sander of FIG. 1.

Referring more particularly to FIG. 2, overlay sander 64 works in part by using an air cylinder 33 to hold the contact or tracking wheel 40 against the overlay surface 54, with the moving belt 1 in between the wheel 40 and the surface 54. The housing 2 has a window in its perimeter right below the wheel 40 where the belt 1 is exposed to the surface of the pipe to be sanded. The cylinder 33 pressure can be regulated to pivot the sander about the axis of shaft 31 and thereby change the force exerted on the work surface by the sander, which determines the rate of removal of material from the work surface by the belt 1. Air cylinder 33 is connected to pivot bracket 28 via shoulder bolt 41, and is also connected to cylinder mount bracket 29. Cylinder mount bracket 29 connects to tilt adjustment block 27. Swivel elbow fittings 36 connect the cylinder 33 to air hose connections (not shown), one for extending the cylinder and the other for retracting it.

Pivot bracket 28 connects to belt housing 2 with shafts 30 and 31, with a bushing 16 between each shaft and the hole in the housing 2 through which the respective shaft 30 or 31 extends, and with shaft 30 threaded into pivot bracket 28 and shaft 31 extending through the bracket 28 and threaded into tilt adjustment block 27. Shaft 31 establishes the pivot axis of the overlay sander, so cylinder 33 pivots the sander about the axis of shaft 31. Shaft collars 34 fix the housing 2 and attached sander assembly to the shaft 30. Set screws 35 fix side adjustment block 42 to height adjustment block 26, which is slideable up and down in tracks 37 and 38 that are fixed to slide 25. Starwheel 32 includes a lead screw that is threaded into the block 26 so that turning the starwheel adjusts the position of the block 26 along the tracks 37 and 38.

Figure 3:
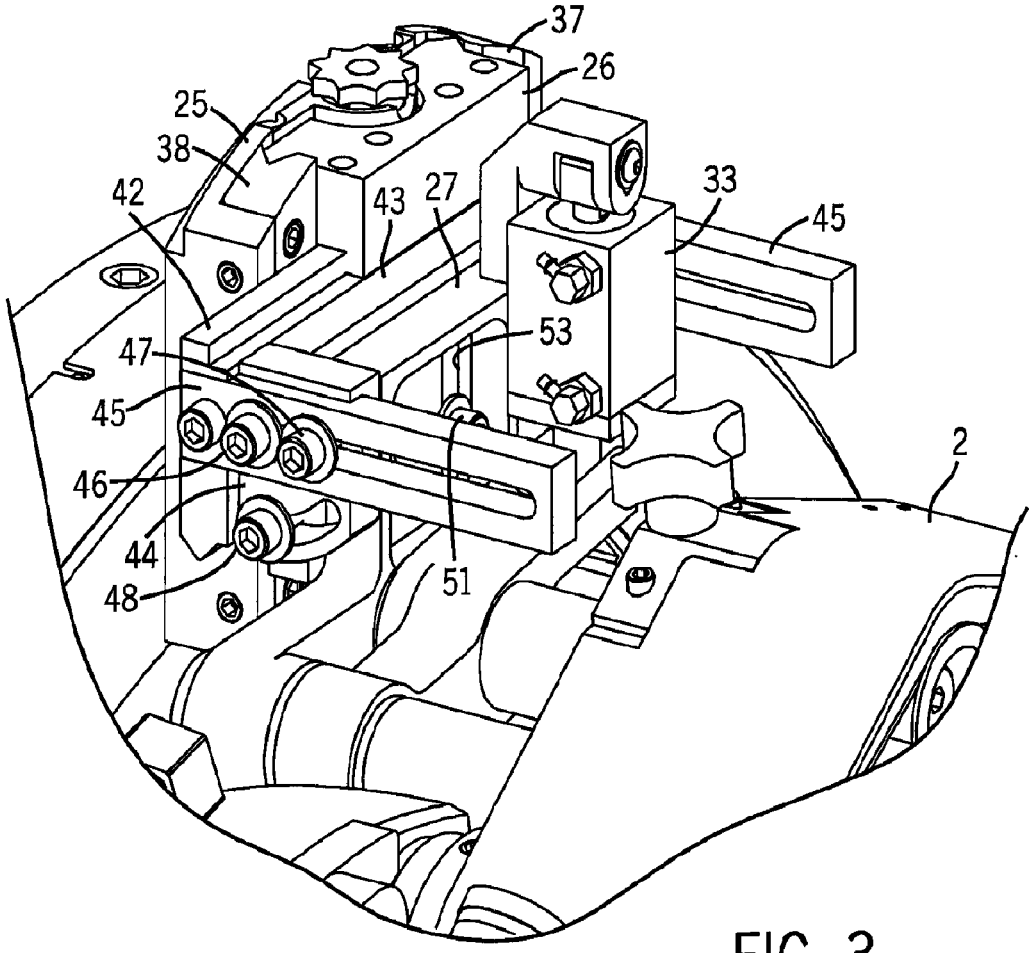
FIG. 3 is a detail perspective view of the area 3-3 of FIG. 1.

Referring to FIGS. 2 and 3, tilt adjustment block 27 and side adjustment block 42 are connected by several components, including intermediate block 43, arcuate slot brackets 44, and linear slot brackets 45. Tilt adjustment block 27 and intermediate block 43 are connected by a fastener 51 in a slot 53 that permits tilt adjustment block 27 to slide relative to intermediate block 43 in the direction height adjustment block 26 may slide. The tilt adjustment block 27 also rotates relative to side adjustment block 42 about an axis parallel to the direction along which side adjustment block 42 may be moved. This permits the overlay sander 64 to tilt and sand up to 45° tapered surfaces.

Referring to FIG. 3, overlay sander 64 is tilted as follows: first, fasteners 46 and 47 are loosened, but are not removed from the assembly. This permits blocks 27 and 43 and arcuate slot brackets 44 to slide in the direction of the slots on linear slot brackets 45. Note that this step is only necessary if intermediate block 43 is originally abutted against side adjustment block 42 so that intermediate block 43 may be rotated in subsequent steps. Next, fastener 48 is loosened, but is not removed from the assembly. Intermediate block 43, tilt adjustment block 27, housing 2, belt 1 and other components may be commonly tilted thereafter relative to side adjustment block 42. When the components have been rotated to a satisfactory working position, the fasteners 46, 47, and 48 are tightened to prevent further rotation and secure the assembly.

Referring again to FIG. 2, on the drive side, drive wheel 39 is connected to housing 2 with drive wheel bracket 18 and bearing 14. Drive wheel 39 further connects to motor 20 using square adapter shaft 24, drive adapter shaft 21 and bearing 19. Motor 20 can be an electric, pneumatic or hydraulic motor. Motor 20 further includes motor mount 8 and housing mount 22 that connects the motor 20 to the housing 2, and adapter plates 23 and 49 that allow electric, pneumatic and/or hydraulic fittings 70 and 71 to connect to motor 20.

The path of endless belt 1 is defined by the axes of wheels 40, 39 and roller wheel 4, and is generally parallel to those axes, which are also generally parallel to the axes of shafts 30 and 31. The connection of the sander to the clamshell biases the sander against the workpiece, under the force of the cylinder 33, so as to permit the sander to follow the surface of the workpiece as the sander removes material from the workpiece. The result is that the surface may not have a fixed center, but being perfectly round is not a requirement in many applications.

Slide 25 is bolted to the face of any size clamshell. An electric variable speed reversible motor (not shown) is used to drive clamshell 56 so overlay sander 64 can be driven either clockwise or counterclockwise around overlay 54. Side adjustment block 42, in conjunction with tracks 37 and 38 and height adjustment block 26, are used to move overlay sander 64 so contact wheel 40 is directly above workpiece 52 and weld overlay 54. Contact wheel 40 is connected to housing 2 with alignment shaft 3, left alignment bracket 13, bearings 14 and washer 17. Starwheel 32 is used to position contact wheel 40 about ½" above workpiece 52. Belt housing 2 is then positioned along shafts 30 and 31 over the top of the overlay 54 by using the shaft collars 34 and guide shaft bushings 16. Belt 1 is put on housing 2. Belt adjustment nut 5 slides in tracks in the housing 2. Spring 12 is compressed between bushing 7 and nut 5 to bias nut 5 away from knob 15, that has a threaded shank that is threaded into the nut 5. Roller wheel 4 is mounted to nut 5 with a shoulder bolt 11 and bearings 10. Belt 1 is tensioned by turning knob 15 to adjust the position of slide nut 5 to change the tension exerted on the belt 1 by the wheel 4.

The sanding is done by first starting clamshell 56 rotating by turning on the electric drive. The overlay sander drive motor 20 is then started to get belt 1 spinning. The cylinder 33 is extended to push contact wheel 40 against work surface 54, with the belt 1 between the contact wheel 40 and the work surface 54. Overlay sander 64 is rotated once around overlay 54, and then the electric drive for the clamshell 56 is reversed to go the other way around overlay 54. This is repeated until the entire overlay surface is smooth. Cylinder 33 is retracted to lift contact wheel 40 off the surface and the clamshell 56 rotation is stopped. The overlay is now smooth but not necessarily round.

The present invention can include a control box (not shown), and associated wiring and air hoses) that is used to start/stop the motors and adjust the air pressure. The present invention can include a tripper mechanism (not shown), as is described in U.S. Pat. No. 5,881,618 for example, which can be used to advance starwheel 32 if desired. A reversing tripper (not shown) can also be installed on machine apparatus 50 to reverse the direction of the clamshell automatically. Also, the direction of the belt 1 of the overlay sander 64 could also be reversed.

A preferred embodiment of the invention has been described in considerable detail. Many modifications and variations to the preferred embodiment described will be apparent to a person of ordinary skill in the art. Therefore, the invention should not be limited to the embodiment described.

I claim:

1. A belt sander, comprising:

a housing;

an endless sanding belt supported on the housing, the belt extending in a path of travel that is generally orthogonal to a first direction;

a first shaft connected to the housing and being generally parallel to the first direction, the housing being pivotable about an axis of the first shaft;

a second shaft connected to the housing and offset from the first shaft to exert a force on the housing so as to pivot the housing about the axis of the first shaft;

a pivot bracket connected pivotably to the first shaft and connected to the second shaft; and at least a first adjustment bracket connected to the pivot bracket so that the housing and the endless sanding belt are translatable relative to the first adjustment bracket.

2. The belt sander of claim 1, wherein the second shaft is approximately parallel to the first shaft.

3. The belt sander of claim 2, further including a biasing element connected to the pivot bracket, the biasing element biasing the pivot bracket relative to the first adjustment bracket.

4. The belt sander of claim 3, wherein the biasing element is an air cylinder.

5. The belt sander of claim 1, wherein the first adjustment bracket connects to the pivot bracket so that the housing and the endless sanding belt are translatable relative to the first adjustment bracket in the first direction.

6. The belt sander of claim 5, the first adjustment bracket connects to a second adjustment bracket so that the housing and the endless sanding belt are translatable relative to the second adjustment bracket in a second direction approximately orthogonal to the first direction.

7. The belt sander of claim 1, wherein the sander is pivotable to sand a tapered surface.

8. A machining apparatus for sanding an external surface of a device, comprising:

a clamshell including a stationary portion connectable to a pipe structure and a rotatable portion, each of which extends for 360 degrees and includes adjoining arcuate segments that allow the portions to be positioned circumferentially around the pipe, the rotatable portion being joined to the stationary portion by bearings so that the rotatable portion can spin about a central axis of the stationary portion when driven by a prime mover;

a belt sander including:

a housing supported by the rotatable portion of the clamshell;

an endless sanding belt supported on the housing, the belt extending in a path of travel that is generally parallel to a first direction;

a drive wheel supported by the housing and in contact with the endless sanding belt;

a tracking wheel supported by the housing and in contact with the endless sanding belt, the tracking wheel including an axis of rotation;

a first shaft connected to the housing and being generally parallel to the first direction, the housing being pivotable about an axis of the first shaft;

a second shaft connected to the housing and offset from the first shaft to exert a force on the housing so as to pivot the housing about the axis of the first shaft;

a pivot bracket connected pivotably to the first shaft and connected to the second shaft; and at least a first adjustment bracket connected to the pivot bracket so that the housing and the endless sanding belt are translatable relative to the first adjustment bracket.

9. A machining apparatus for sanding an external surface of a device, comprising:

a clamshell including a stationary portion connectable to a pipe structure and a rotatable portion, each of which extends for 360 degrees and includes adjoining arcuate segments that allow them to be positioned circumferentially around the pipe, the rotatable portion being joined to the stationary portion by bearings so that the rotatable portion can spin about a central axis of the stationary portion when driven by a prime mover;

a belt sander connected to the rotatable portion, the belt sander having:

a housing;

an endless sanding belt supported by the housing, the belt extending in a path of travel that is generally orthogonal to a first direction;

a motor that drives the belt, the belt sander being connected to the rotatable portion so as to sand a surface of the workpiece; and a first shaft connected to the housing and being generally parallel to the first direction, the housing being pivotable about an axis of the first shaft;

a second shaft connected to the housing and offset from the first shaft to exert a force on the housing so as to pivot the housing about the axis of the first shaft;

a pivot bracket connected pivotably to the first shaft and connected to the second shaft; and at least a first adjustment bracket connected to the pivot bracket so that the housing and the endless sanding belt are translatable relative to the first adjustment bracket;

wherein the connection of the sander to the rotatable portion of the clamshell biases the sander against a surface of the workpiece so as to permit the sander to follow the surface of the workpiece as it removes material from the workpiece.

10. The machining apparatus of claim 9, further including a first shaft connected to the housing, wherein the belt sander is pivoted about the first shaft against the surface of the workpiece in operation.

11. The machining apparatus of claim 9, further including a biasing element that biases the sander against the surface of the workpiece.

12. The machining apparatus of claim 11, wherein the biasing element is an air cylinder.

13. The machining apparatus of claim 10, further including a slide bracket connected to the housing, the slide bracket including adjustments in mutually orthogonal slide directions.

14. The machining apparatus of claim 13, wherein the sander is pivotable toward the workpiece about an axis that is approximately orthogonal to the slide directions.

15. The machining apparatus of claim 9, wherein the sander is pivotable to sand a tapered surface.

16. A method of sanding a weld overlay on a pipe, comprising the steps of:

1) connecting a clamshell including a stationary portion connectable to a pipe structure and a rotatable portion, each of which extends for 360 degrees and includes adjoining arcuate segments that allow them to be positioned circumferentially around the pipe, the rotatable portion being joined to the stationary portion by bearings so that the rotatable portion can spin about a central axis of the stationary portion when driven by a prime mover;

2) attaching a belt sander to the rotating portion, the belt sander including:

a housing;

an endless sanding belt supported by the housing, the belt extending in a path of travel that is generally orthogonal to a first direction;

a first shaft connected to the housing and being generally parallel to the first direction, the housing being pivotable about an axis of the first shaft;

a second shaft connected to the housing and offset from the first shaft to exert a force on the housing so as to pivot the housing about the axis of the first shaft;

a pivot bracket connected pivotably to the first shaft and connected to the second shaft; and at least a first adjustment bracket connected to the pivot bracket so that the housing and the endless sanding belt are translatable relative to the first adjustment bracket;

3) driving the endless belt relative to the housing;

4) contacting the surface of the pipe with the endless sanding belt; and 5) revolving the belt sander around the pipe using the rotatable portion of the clamshell.

17. The method of claim 16, further including the step of reversing the direction of revolution of the belt sander around the pipe.

18. The belt sander of claim 1, further comprising an adjustment nut being movable relative to the housing to tension the endless sanding belt.

19. The belt sander of claim 6, further comprising a third adjustment bracket connected to the pivot bracket and the first adjustment bracket so that the housing and the endless sanding belt are pivotable relative to the first adjustment bracket about an axis in a third direction approximately orthogonal to the first direction and the second direction.

* * * * *